United States Patent [19]

Wilson

[11] Patent Number: 4,678,234

[45] Date of Patent: Jul. 7, 1987

[54] FOOTREST

[76] Inventor: Ian G. Wilson, 17/201 Waterloo Road, Marsfield, New South Wales 2122, Australia

[21] Appl. No.: 840,520

[22] Filed: Mar. 17, 1986

[30] Foreign Application Priority Data

Mar. 20, 1985 [AU] Australia ..... PG9821

[51] Int. Cl.[4] ..... A47C 9/12

[52] U.S. Cl. ..... 297/439; 297/423

[58] Field of Search ..... 297/439, 438, 424, 423; 108/53.1, 53.3, 53.5, 91, 150; 248/188.2, 188.9; 74/564

[56] References Cited

U.S. PATENT DOCUMENTS

| | | | |
|---|---|---|---|
| 2,108,241 | 2/1938 | Wallace | 297/439 X |
| 2,654,420 | 10/1953 | Rogers | 297/438 X |
| 3,467,033 | 9/1969 | Sienkiewicz et al. | 108/150 |
| 3,610,172 | 10/1971 | Wharton | 108/53.3 X |
| 3,650,562 | 3/1972 | Adler | 297/439 |
| 3,651,769 | 3/1972 | Foley | 108/56.1 |
| 3,853,073 | 12/1974 | Flum et al. | 108/53.1 X |
| 3,867,887 | 2/1975 | Saidel | 108/56.3 X |
| 3,926,321 | 12/1975 | Trebilcock | 108/53.1 X |
| 4,441,758 | 4/1984 | Fleischer et al. | 297/439 |
| 4,549,767 | 10/1985 | Hampshire et al. | 297/439 |

FOREIGN PATENT DOCUMENTS

| | | | |
|---|---|---|---|
| 694008 | 6/1940 | Fed. Rep. of Germany | 297/439 |
| 645932 | 11/1928 | France | 297/439 |
| 386640 | 4/1965 | Switzerland | 297/439 |

*Primary Examiner*—Kenneth J. Dorner
*Assistant Examiner*—José V. Chen
*Attorney, Agent, or Firm*—Ladas & Parry

[57] ABSTRACT

A footrest providing for selective height and inclination adjustment and comprising a foot platform formed integrally with depending legs having chamfered outer ends and detachable foot plates to support the platform from a floor with an inclination from a rear edge to a forward edge, alternative foot plates having a chamfered face may be provided to modify the inclination of the platform and are reversible so as to increase or decrease the inclination as desired, spacing pieces attachable between the foot plates and the legs for selection of height of the platform, and means for storing beneath the platform the foot plates and spacing pieces not selected for use.

9 Claims, 3 Drawing Figures

FOOTREST

This invention relates to footrests of the kind provided for the comfort of a seated person.

A person seated at a desk, or table, for long periods, such as required of typists, must be comfortably postured to avoid early fatigue, or even injury. Awareness of this factor has grown with the alarming incidence of Repetitive Strain Injury (RSI) with the advent of computers, word processors, and the like. Adjustable chairs enable an operator to select a comfortable height with respect to the desk, but conventional footrests being of fixed height are inadequate for use by many people who are of other than average height or physique.

It is the principal object of this invention to provide a footrest which is at least of adjustable height and is compact.

In accordance with the invention there is provided a footrest comprising a body portion including a platform having a front and a rear and a pair of laterally spaced legs depending from the platform and having outer ends chamfered to support the platform from a floor surface at a downward inclination from its rear to its front, a foot member detachably connected to the underside of each of said legs and when attached determining the minimum height of said platform from the floor, and spacing pieces detachably connected between each of said foot members and its respective leg to achieve a selected increase in height of said platform.

The invention will be described in more detail with reference to the accompanying drawings, in which.

Figure 1:
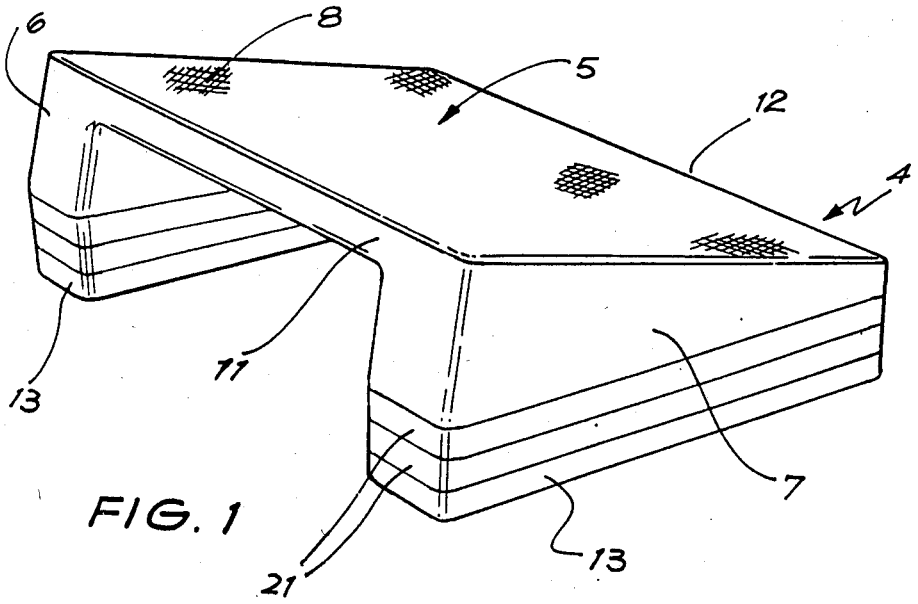
FIG. 1 shows in perspective a footrest constructed according to this invention.

With respect to the drawings, it will be seen that the footrest consists of a main body portion 4 composed of a platform 5, preferably of rectangular shape, with a pair of legs 6 and 7 spaced laterally on the platform 5 and depending therefrom to provide support from a floor surface of the platform 5. A layer 8 of carpet, or other attractive non-slip material, may be secured to the upper surface of the platform 5. The platform 5 and its supporting legs 6 and 7 may be formed integrally from thermoplastic material with the underside 9 of the platform 5 provided with reinforcing ribs 10. It will be noted that several adjacent ones of these ribs 10 are of greater spacing than the remainder, for a purpose to be explained hereafter. It will also be noted that the feet 6 and 7 are hollow, open at their outer end and have a chamfer 26 thereat from the rear edge 11 to the front edge 12 of the platform 5. Therefore, when stood upon its legs 6 and 7 the inclination of the platform is forwardly as shown in FIG. 1.

A foot member 13, with attached felt or rubberised friction pads 14, has a sunken central portion 15 provided with a mounting hole 16, and an array of depending locating lugs 17 inwardly spaced from the periphery of the foot member 13 which is generally of the same peripheral dimension as the legs 6 and 7. Hence, a foot member 13 may be assembled upon the outer end of one of the legs 6 and 7 with its lugs 17 nesting tightly within the periphery of the leg. A projecting mounting threaded stud 18 anchored upon a moulded post 19 within each of the legs 6 and 7 penetrates the hole 16 for screwing thereon of a retaining nut 20. With a foot member 13 thus secured to the underside of each leg 6 and 7 the footrest is in its condition for use at a minimum height.

Spacing pieces 21 having similar peripheral dimension and depending locating lugs 17 as the foot members 13 may be stored upon the underside 9 of the platform 5 between the widely spaced ribs 10, refer to above. A threaded stud 18 embedded within a moulded post 19 depends from the underside 9 of the platform 5 for attachment of the spacing pieces 21 thereto by nuts 20. All of these spacing pieces 21 are identical, of thermoplastic shell form with an array of apertures 22 for press-fit accommodation of the lugs 17 of another spacing piece 21 positioned above. Any number of spacing pieces 21 may be fixed in an interlocked stack in this manner. Each piece 21 has a sunken central portion 15 provided with a hole 16, and additionally has an adjacent threaded stud 18 embedded in a moulded post 19 and projecting above the surface of the spacing piece 21. All of these studs 18 provided in the legs 6 and 7 and the spacing pieces 21 are equally spaced with their adjacent holes 16 in the pieces 21, to opposite sides of a centre line through any stack of spacing pieces 21. This arrangement permits all of the spacing pieces 21 to be of identical construction while enablinq a stack of pieces 21 to be assembled upon a leg 6 or 7 together with a foot member 13 by rotational displacement through 180° of each alternate spacing piece 21. Similarly, the hole 16 provided in the foot member 13 is offset from the centre point of the member 13 so that the member 13 may complete the stack in either one of two rotational positions depending upon the positioning of the stud 18 in the spacing piece 21 immediately beneath. In similar fashion a number of spacing pieces 21 may be arranged in a stack in their storage position secured to the underside 9 of the platform 5.

It will be noted that an advantage of the above construction of the spacing pieces 21, and the foot members 13 is that they are all of identical moulded shape so that when composed of thermoplastic material only a single moulding die will be required. The post 19 of the foot members 13 is not provided with a stud, and slots 24 serving to anchor the pads 14 on each foot member 13 serve no purpose on the spacing pieces 21.

Figure 3:
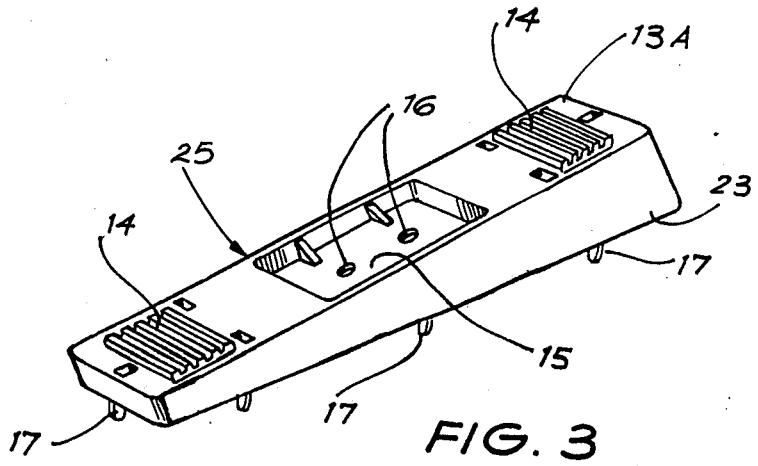
FIG. 3 shows an alternative foot member used for inclination adjustment.
Figure 2:
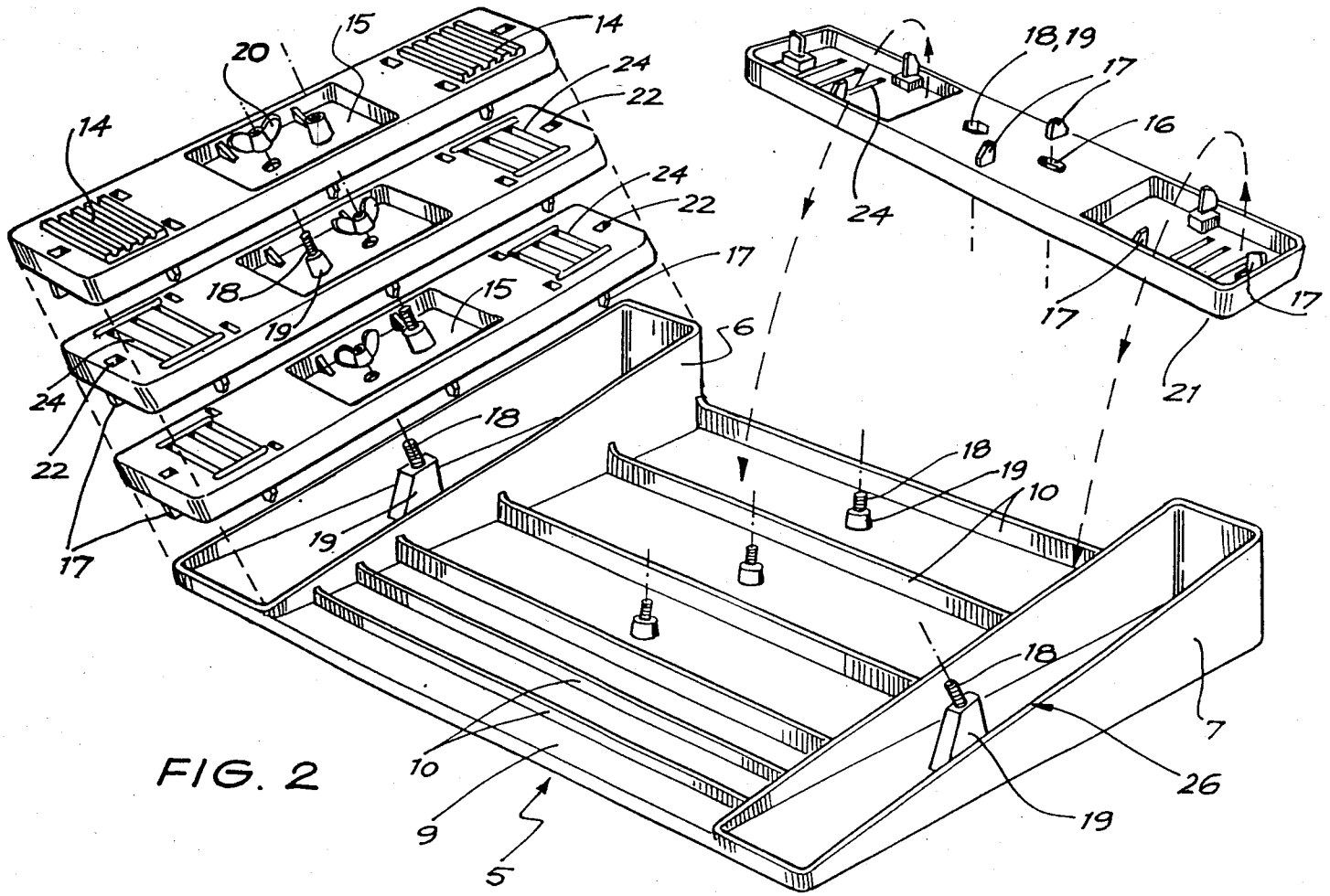
FIG. 2 is an exploded perspective of the footrest inverted for height adjustment.

In some instances it will be desirable to alter the inclination of the platform 5. This can be achieved by use of alternative foot members 13A shown in FIG. 3. They are of similar construction to the foot members 13 except for the provision of a skirt 23 which has a chamfer 25 at its outer end. This taper is preferably 2.5° whereas the taper of the legs 6 and 7 is 12.5°. Therefore, depending upon in which rotated position the foot member 13A is attached to the underlying spacing piece 21, or the stud 18 providing in a respective leg 6 or 7, the inclination of the platform can be altered to 10° or 15°. Consequently, the user of the footrest will be provided with a choice of three different inclinations. It will be appreciated that the alternative foot members 13A, or even foot members 13, may be stored beneath the platform 5 as the last member in any stored stack.

Whereas a preferred embodiment has been described in the foregoing passages it should be understood that other forms and refinements are possible within the scope of this invention as defined by the appended claims.

What I claim is:

1. A footrest comprising a foot member, a body portion composed of moulded thermoplastic material and having a platform integrally formed with a pair of legs depending at opposite sides from said platform and each having a chamfered outer end to support the platform from a floor surface at a downward inclination from a rearward edge to a forward edge thereof, a plurality of spacing pieces having moulded thermoplastic bodies of identical form and having a two-part thread connecting means and a hole, said connecting means and hole equally offset from, and at opposite sides of, a center point of said body, thereby allowing stacking of a selected number of said spacing pieces with one part of said connecting means of one spacing piece passing through said hole of an adjacent spacing piece and receiving the second part of said connecting means for fastening of said spacing pieces together, a projecting stud at the outer end of each of said legs for insertion through the hole in a selected one of said spacing pieces for fastening thereto by a nut, and said foot member detachably connected beneath each of said legs and any selected number of spacing pieces, said spacing pieces detachably connected between each of said foot members and its respective leg.

2. A footrest as claimed in claim 1, further comprising individual means for said connection of said foot members and said spacing pieces, each of said individual means including a threaded stud and a nut therefor with either one of said stud and nut being fixed with respect to one of said spacing pieces.

3. A footrest as claimed in claim 2, wherein each of said spacing pieces has one of said threaded studs fixed thereon and a hole for entry of a stud of an adjacent one of said spacing pieces, said stud and hole being equally offset to opposite sides of a centre point of said spacing piece, whereby in assembling a stack of said spacing pieces alternate ones of said spacing pieces in the stack are rotated 180° about their centre points from the remainder of said spacing pieces.

4. A footrest as claimed in claim 1, wherein means is provided beneath the body portion to attach for storage between said legs those of said spacing pieces not in use.

5. A footrest as claimed in claim 4, wherein said attaching means is at least one mounting stud embedded in and depending from the underside of said platform.

6. A footrest as claimed in claim 1, wherein means is provided between said legs and on the underside of said platform to attach thereto for storage those of said spacing pieces not selected for use.

7. A footrest as claimed in claim 1, wherein each of said foot members has a body with a depending skirt with a chamfered outer end, and has two holes equally offset to opposite sides of the centre line of said body, whereby said foot member can be connected to increase or decrease the downward inclination of said platform.

8. A footrest as claimed in claim 7, wherein the outer end of said legs are chamfered at an angle of 12.5°, and the chamfer at the outer end of said foot member is 2.5°.

9. A footrest as claimed in claim 7, wherein said legs are open at their outer end, said spacing pieces have an array of apertures arranged around and within their periphery, and the foot member and all of said spacing pieces have a similar array of depending lugs within the confines of their periphery, whereby in assembly tight nesting of said lugs within the outer end of the legs or within said apertures occurs.

* * * * *